US010573452B2

(12) United States Patent
Shijo et al.

(10) Patent No.: US 10,573,452 B2
(45) Date of Patent: Feb. 25, 2020

(54) INDUCTOR FOR WIRELESS POWER TRANSMISSION

(71) Applicant: KABUSHIKI KAISHA TOSHIBA, Tokyo (JP)

(72) Inventors: Tetsu Shijo, Tokyo (JP); Akiko Yamada, Tokyo (JP); Shuichi Obayashi, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 396 days.

(21) Appl. No.: 15/266,132

(22) Filed: Sep. 15, 2016

(65) Prior Publication Data

US 2017/0004916 A1 Jan. 5, 2017

Related U.S. Application Data

(63) Continuation of application No. PCT/JP2014/065703, filed on Jun. 13, 2014.

(51) Int. Cl.

| | |
|---|---|
| ***H01F 27/02*** | (2006.01) |
| ***H01F 27/26*** | (2006.01) |
| ***H01F 27/245*** | (2006.01) |
| ***H01F 27/255*** | (2006.01) |

(Continued)

(52) U.S. Cl.

CPC ..... *H01F 27/266* (2013.01); *H01F 27/02* (2013.01); *H01F 27/245* (2013.01); *H01F 27/255* (2013.01); *H01F 27/325* (2013.01); *H01F 27/022* (2013.01); *H01F 38/14* (2013.01); *H01F 2027/329* (2013.01)

(58) Field of Classification Search

CPC ..... H01F 27/00–36

USPC ..... 336/65, 90, 92–96, 200, 206–208, 232

See application file for complete search history.

(56) References Cited

U.S. PATENT DOCUMENTS

| | | | | |
|---|---|---|---|---|
| 6,208,231 | B1 * | 3/2001 | Oosuka | H01F 27/327 123/634 |
| 7,009,483 | B2 * | 3/2006 | Takeyama | H01F 27/327 336/96 |
| 9,312,729 | B2 | 4/2016 | Yasuda et al. | |

(Continued)

FOREIGN PATENT DOCUMENTS

| | | |
|---|---|---|
| JP | 57-31827 | 2/1982 |
| JP | 58-219723 | 12/1983 |

(Continued)

OTHER PUBLICATIONS

International Search Report dated Oct. 7, 2014, issued by the Japanese Patent Office in International Application No. PCT/JP2014/065703; 2 pages.

(Continued)

*Primary Examiner* — Tuyen T Nguyen

(74) *Attorney, Agent, or Firm* — Finnegan, Henderson, Farabow, Garrett & Dunner, L.L.P.

(57) ABSTRACT

An inductor according to one embodiment includes a magnetic core, a case, a winding, and a resin. The case is configured to house the magnetic core. The winding is configured to be wound around the case. The resin is configured to be formed of a first resin to cover the case and the winding. A difference between an inside dimension of the case and a dimension of the magnetic core in the same direction is greater than a variation of a dimension of the case in the direction when forming the resin.

18 Claims, 20 Drawing Sheets

(51) Int. Cl.
*H01F 27/32* (2006.01)
*H01F 38/14* (2006.01)

(56) References Cited

U.S. PATENT DOCUMENTS

| | | | |
|---|---|---|---|
| 2008/0129246 | A1 | 6/2008 | Morita et al. |
| 2013/0135077 | A1 | 5/2013 | Shijo et al. |
| 2014/0084697 | A1 | 3/2014 | Yasuda et al. |
| 2014/0253275 | A1 | 9/2014 | Shijo et al. |

FOREIGN PATENT DOCUMENTS

| | | |
|---|---|---|
| JP | 2-285613 | 11/1990 |
| JP | 6-92679 | 4/1994 |
| JP | 6-215927 | 8/1994 |
| JP | 2002-110433 | 4/2002 |
| JP | 2002-164229 | 6/2002 |
| JP | 2008-120239 | 5/2008 |
| JP | 2010-172084 | 8/2010 |
| JP | 2012-209327 | 10/2012 |
| JP | 2013-55229 | 3/2013 |
| JP | 2013-106477 | 5/2013 |
| JP | 2013-172503 | 9/2013 |
| JP | 2014-96435 | 5/2014 |
| JP | 2014-197663 | 10/2014 |
| JP | 2015-88668 | 5/2015 |
| WO | WO-2012/099170 | 7/2012 |
| WO | WO-2013/125372 | 8/2013 |

OTHER PUBLICATIONS

International Preliminary Report on Patentability dated Dec. 22, 2016, issued by The International Bureau of WIPO in International Application No. PCT/JP2014/065703; 2 pages.
Written Opinion dated Oct. 7, 2014, issued by the Japanese Patent Office in International Application No. PCT/JP2014/065703; 8 pages.

* cited by examiner

INDUCTOR FOR WIRELESS POWER TRANSMISSION

CROSS REFERENCE TO RELATED APPLICATION

This application is a Continuation of International Application No. PCT/JP2014/065703, filed on Jun. 13, 2014, the entire contents of which is hereby incorporated by reference.

FIELD

Embodiments described herein relate to an inductor for wireless power transmission.

BACKGROUND

Conventionally, in order to improve mechanical strength and heat dissipation of an inductor for wireless power transmission, an inductor having a structure in which a magnetic core and a winding are covered with a resin has been used. Such an inductor is manufactured by casting the resin so as to cover the magnetic core and the winding. In the conventional inductor, the magnetic core and the resin have been brought into contact with each other, so that stress has been applied to the magnetic core due to curing shrinkage of the resin occurred when performing the casting. When the stress is applied to the magnetic core, a magnetostriction of the magnetic core is impeded. This creates a problem such as reduction in inductance value or increase in core loss.

Accordingly, in order to suppress the stress applied to the magnetic core, there has been proposed an inductor in which a magnetic core is covered with a stress-absorbing member. However, this inductor has a problem that when a thickness of the stress-absorbing member is insufficient, it is not possible to sufficiently suppress stress.

DETAILED DESCRIPTION

An inductor for wireless power transmission in which stress applied to a magnetic core is suppressed, is provided.

An inductor according to one embodiment includes a magnetic core, a case, a widing, and a resin. The case is configured to house the magnetic core. The winding is configured to be wound around the case. The resin is configured to be formed of a first resin to cover the case and the winding. A difference between an inside dimension of the case and a dimension of the magnetic core in the same direction is greater than a variation of a dimension of the case in the direction when forming the resin.

Hereinafter, embodiments of the present invention will be described with reference to the drawings.

(First Embodiment)

Figure 1:
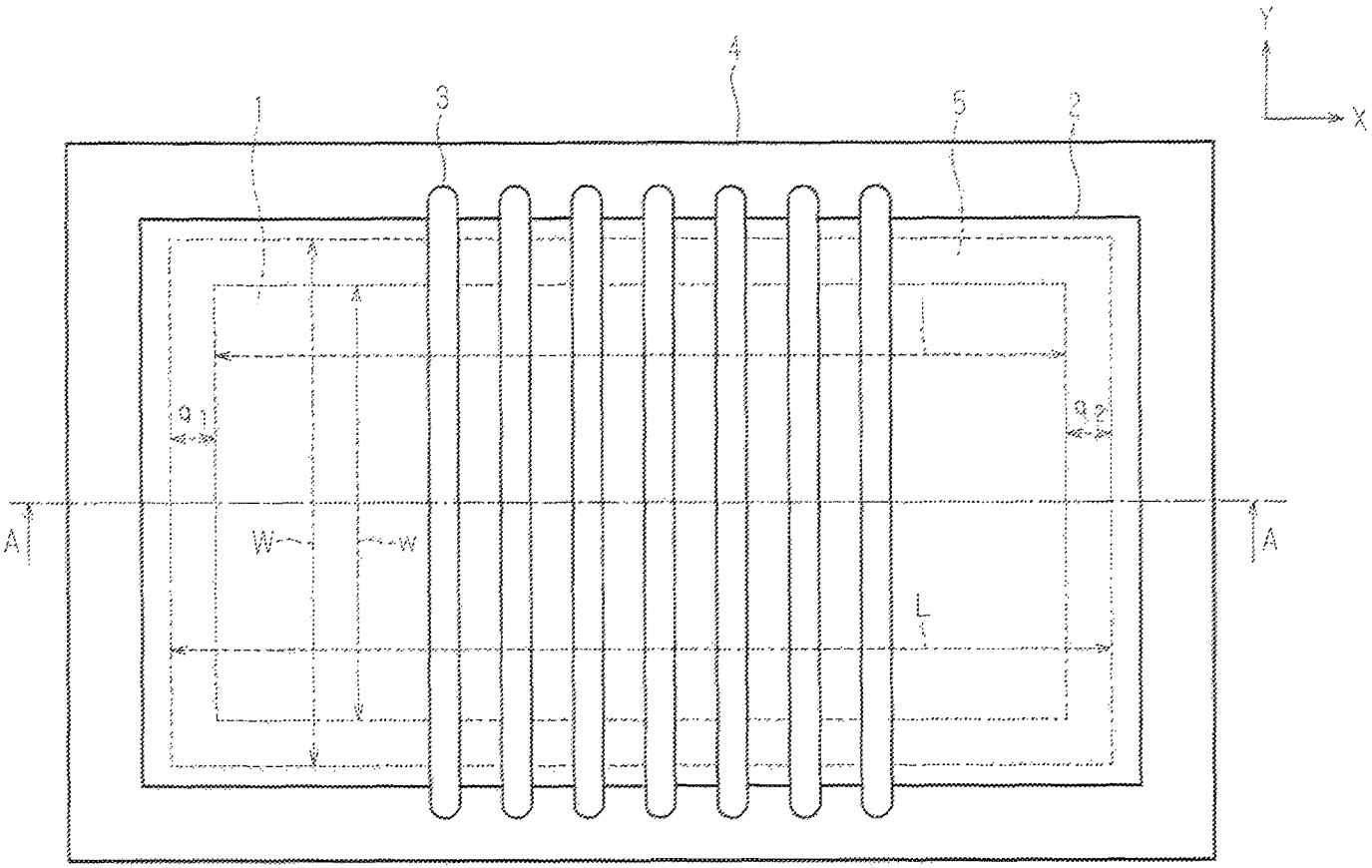
FIG. 1 is a plan view illustrating one example of an inductor according to a first embodiment.
Figure 2:
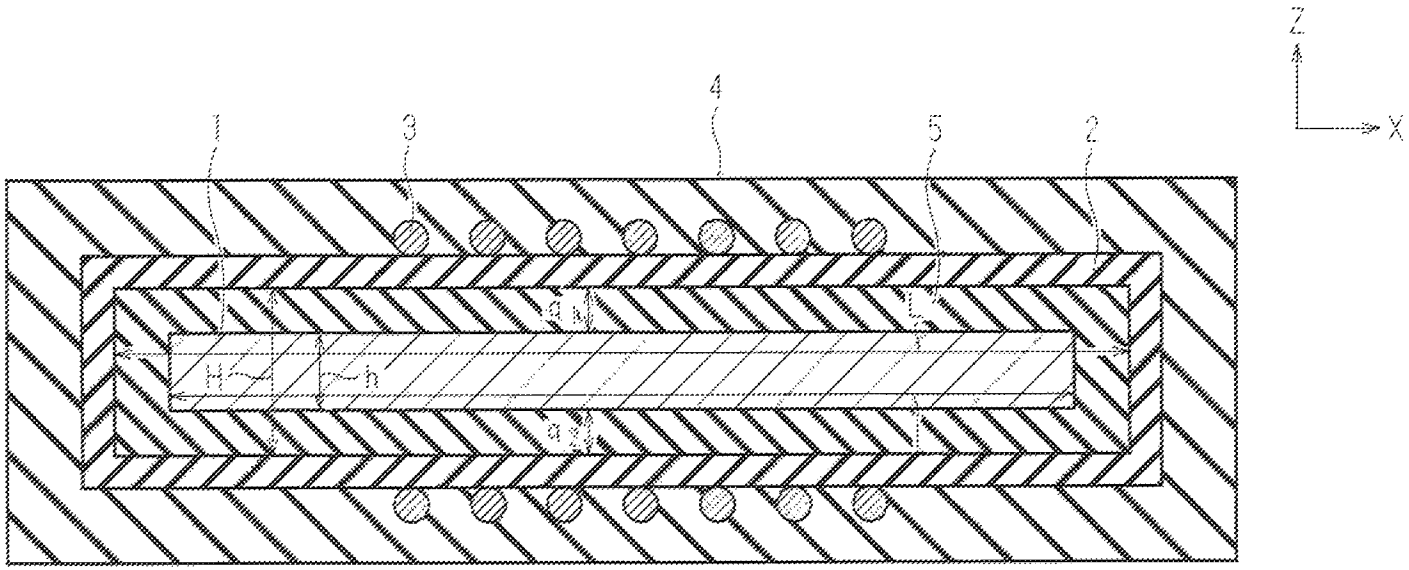
FIG. 2 is a sectional view of the inductor taken along line A-A in FIG. 1.

First, an inductor according to a first embodiment will be described with reference to FIG. 1 and FIG. 2. FIG. 1 is a plan view illustrating one example of the inductor according to the present embodiment. FIG. 2 is a sectional view taken along line A-A (sectional view of XZ plane) in FIG. 1. As illustrated in FIG. 1 and FIG. 2, the inductor according to the present embodiment includes a magnetic core 1, a case 2, a winding 3, a resin 4, and a stress-absorbing member 5. Note that in FIG. 1, the resin 4 is illustrated in a transparent state, The magnetic core 1 is formed of magnetic substance of ferrite or the like. Hereinafter, a direction of magnetic flux generated inside the magnetic core 1 when current is passed through the winding 3 is referred to as a magnetic flux direction (a direction indicated by an arrow mark X in FIG. 1 and FIG. 2), and directions perpendicular to the magnetic flux direction are referred to as a width direction and a thickness direction. It is set that the width direction is a direction indicated by an arrow mark Y in FIG. 1, and the thickness direction is a direction indicated by an arrow mark Z in FIG. 2. Further, a dimension in the magnetic flux direction, a dimension in the width direction, and a dimension in the thickness direction of the magnetic core 1, are set to l, w, and h, respectively.

The case 2 houses therein the magnetic core 1. The resin 4 is formed on the outside of the case 2, so that the resin 4 and the magnetic core 1 are not brought into contact with each other, and thus stress due to curing shrinkage of the resin 4 and thermal stress are not directly applied to the magnetic core 1. Therefore, by providing the case 2, it is possible to suppress the stress applied to the magnetic core 1.

The case 2 is formed of an insulating material. As a material of the case 2, for example, a thermosetting resin such as epoxy resin, a thermoplastic resin such as polypropylene, ABS resin, or polyethylene, glass, and the like are used. Hereinafter, an inside dimension in the magnetic flux direction, an inside dimension in the width direction, and an inside dimension in the thickness direction of the case 2, are set to L, W, and H, respectively. The inside dimension of the case 2 corresponds to a dimension between inside walls of the case 2 in each of the directions. Note that the above-described L, W, and H are inside dimensions of the case 2 when current is not passed through the winding 3. A relation between the inside dimension of the case 2 and the dimension of the magnetic core 1 will be described later.

The winding 3 is wound around the case 2. As the winding 3, for example, a copper wire, an aluminum wire, a litz wire, and the like are used. When current is passed through the winding 3, the inductor generates a magnetic field.

The resin 4 is formed of an insulating material (first resin) so as to cover the case 2 and the winding 3. The resin 4 is formed after the magnetic core 1 is housed inside the case 2, and the winding 3 is wound around the case 2. As a method of forming the resin 4, for example, casting or injection molding is used. Further, it is also possible to use a lamination molding method using a 3D printer. The material of the resin 4 is selected in accordance with these manufacturing methods. As the material of the resin 4, for example, a thermosetting resin such as epoxy resin, a thermoplastic resin such as polypropylene, ABS resin, or polyethylene, glass, and the like are used.

The material of the resin 4 may also be the same as the material of the case 2. In this case, it is possible to improve adhesive strength between the resin 4 and the case 2. This makes it possible to suppress interfacial peeling between the resin 4 and the case 2 when vibration or shock is applied to the inductor.

Further, the material of the resin 4 and the material of the case 2 may also be different. For example, there can be considered a case where the case 2 is formed of a resin with high strength, and the resin 4 is molded by a resin with high thermal conductivity. Consequently, it is possible to improve strength and heat radiation performance of the inductor. Further, by forming the resin 4 using a resin with low viscosity, it is possible to improve productivity of the inductor.

Note that if, at the time of forming the resin 4, the material of the resin 4 enters the case 2, there is a possibility that thermal stress is applied to the magnetic core 1. For this reason, the case 2 is preferably sealed before forming the resin 4, in order to prevent the material of the resin 4 from entering the case 2.

The stress-absorbing member 5 is provided, between the case 2 and the magnetic core 1, so as to cover at least a part of the magnetic core 1. The stress-absorbing member 5 fixes the magnetic core 1 at a position inside the case 2, and at the same time, it suppresses stress applied from the outside to the magnetic core 1.

The stress-absorbing member 5 is formed of an insulating material or a semiconductive material. The semiconductive material mentioned here indicates a material having electric conductivity higher than that of an insulator, and having electric conductivity lower than that of a conductor. Therefore, the semiconductive material has conductivity higher than that of the materials of the case 2 and the resin 4. Concretely, the semiconductive material is a material whose electric conductivity is not less than $10^{-6}$ S/m nor more than $10^{6}$ S/m. The semiconductive material is, for example, a mixture of an insulator and a conductor such as carbon.

As a material of the stress-absorbing member 5, for example, a foamed resin, a rubber-based resin, a gel-based resin, a nonwoven fabric, or the like is used. Further, it is also possible to use synthetic rubber such as acrylic rubber or silicon rubber. When the stress-absorbing member 5 is formed of the semiconductive material, it is possible to mitigate electric field concentration, so that partial discharge between the magnetic core 1 and the winding 3 can be suppressed.

Note that the stress-absorbing member 5 is preferably formed of a material having a modulus of elasticity lower than that of the material of the resin 4, in order to absorb stress caused by the curing shrinkage of the resin 4. Further, in order to absorb stress caused by thermal shrinkage of the case 2, the stress-absorbing member 5 is preferably formed of a material having a modulus of elasticity lower than that of the material of the case 2. Further, in order to improve heat radiation performance exhibited by the stress-absorbing member 5 from the magnetic core 1, the stress-absorbing member 5 is preferably provided so as to cover the entire magnetic core 1, as illustrated in FIG. 1 and FIG. 2.

Here, the relation between the inside dimension of the case 2 and the dimension of the magnetic core 1 will be described. The magnetic core 1 and the case 2 are designed to set a minimum value of a difference between an inside dimension P of the case 2 and a dimension p of the magnetic core 1 in the same direction to be greater than a variation ΔP of the inside dimension of the case 2 in the direction ($\min(P-p)>\Delta P$). For example, if attention is focused on the magnetic flux direction, the magnetic core 1 and the case 2 are designed to set a minimum value of a difference between the inside dimension L in the magnetic flux direction of the case 2 and the dimension l in the magnetic flux direction of the magnetic core 1 to be greater than a variation ΔL of the inside dimension of the case 2 in the magnetic flux direction.

The variation ΔP of the inside dimension of the case 2 indicates a maximum value of the dimension of the case 2 which is shrunk due to thermal shrinkage when manufacturing the inductor (when forming the resin 4). The thermal shrinkage when manufacturing the inductor indicates, for example, thermal shrinkage which occurs when a curing temperature when a thermosetting resin is thermoset (85 degrees to 150 degrees) or a temperature when a thermoplastic resin is injection-molded (180 degrees or higher) returns to a room temperature, or the like. When the minimum value of the inside dimension of the case 2 to be shrunk is set to $P_{MIN}$, a relation of $\Delta P=P-P_{MIN}$ is satisfied.

The variation ΔP corresponds to a product of a linear expansion coefficient α (%/° C.) of the case 2, the inside dimension P of the case 2, and a variation ΔT (° C.) of temperature ($\Delta P=\alpha P\Delta T$). The variation ΔT of temperature corresponds to a maximum value of the variation of temperature, of the case 2, increased at the time of manufacturing the inductor. When the temperature of the case 2 at the minimum temperature at which the inductor is operated (operating temperature of the inductor) is set to T, and the maximum value of the temperature, of the case 2, increased at the time of manufacturing the inductor is set to $T_{MAX}$, a relation of $\Delta T=T_{MAX}-T$ is satisfied. The temperature T of the case 2 can be arbitrarily set in accordance with an environment under which the inductor is placed. For example, when an operating temperature of EV is from −10 degrees to 40 degrees, T becomes −10 degrees.

As described above, the magnetic core 1 and the case 2 are designed to satisfy the relation of $\min(P-p)>\alpha P\Delta T$ in the respective directions. Specifically, the following expressions are satisfied at arbitrary portions in the magnetic flux direction, the width direction, and the thickness direction, respectively, magnetic flux direction: $L-I>\alpha L\Delta T$ width direction: $W-w>\alpha W\Delta T$ thickness direction: $H-h>\alpha H\Delta T$.

For example, when it is set that $\alpha=0.01\%/^\circ$ C., L=100 mm, and $\Delta T=100^\circ$ C., a relation of I<99 mm is satisfied.

By designing the magnetic core 1 and the case 2 as described above, even if thermal shrinkage occurs in the case 2, it is possible to prevent stress caused by the thermal shrinkage of the case 2 from being directly applied to the magnetic core 1.

Note that since the stress-absorbing member 5 is provided between the magnetic core 1 and the case 2, a total value Q of the thickness in each direction corresponds to a difference between the inside dimension P of the case 2 and the dimension p of the magnetic core 1 (Q=P−p). The total value Q of the thickness is a total value of the thickness of the stress-absorbing member 5 provided on one side of the magnetic core 1 and the thickness of the stress-absorbing member 5 provided on the other side of the magnetic core 1.

For example, as illustrated in FIG. 1 and FIG. 2, when the thickness of the stress-absorbing member 5 provided on an upper side of the magnetic core 1 is $q_1$, and the thickness of the stress-absorbing member 5 provided on a lower side of the magnetic core 1 is $q_2$, the total value Q of the thicknesses of the stress-absorbing member 5 in the thickness direction is obtained through an expression of $Q=q_1+q_2$.

As described above, according to the present embodiment, the strength and the heat radiation performance of the inductor can be improved by the resin 4. Further, with the use of the case 2 and the stress-absorbing member 5, it is possible to suppress the stress applied to the magnetic core 1 due to the curing shrinkage of the resin 4. Furthermore, by using the stress-absorbing member 5, it is possible to suppress the stress applied to the magnetic core 1 due to the thermal shrinkage of the case 2. Therefore, it is possible to suppress the reduction in inductance value and the increase in core loss of the inductor.

(Second Embodiment)

Figure 3:
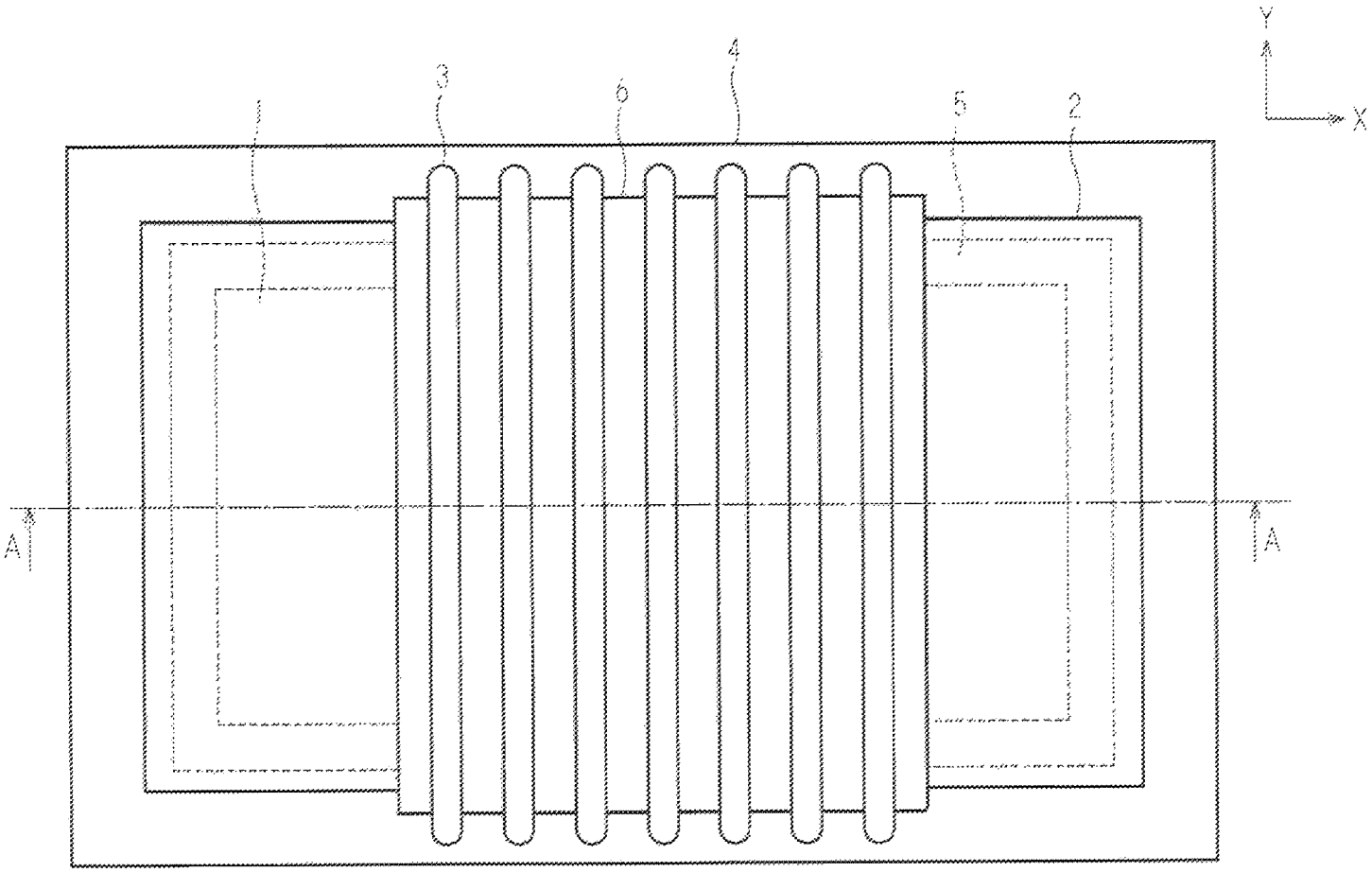
FIG. 3 is a plan view illustrating one example of an inductor according to a second embodiment.
Figure 4:
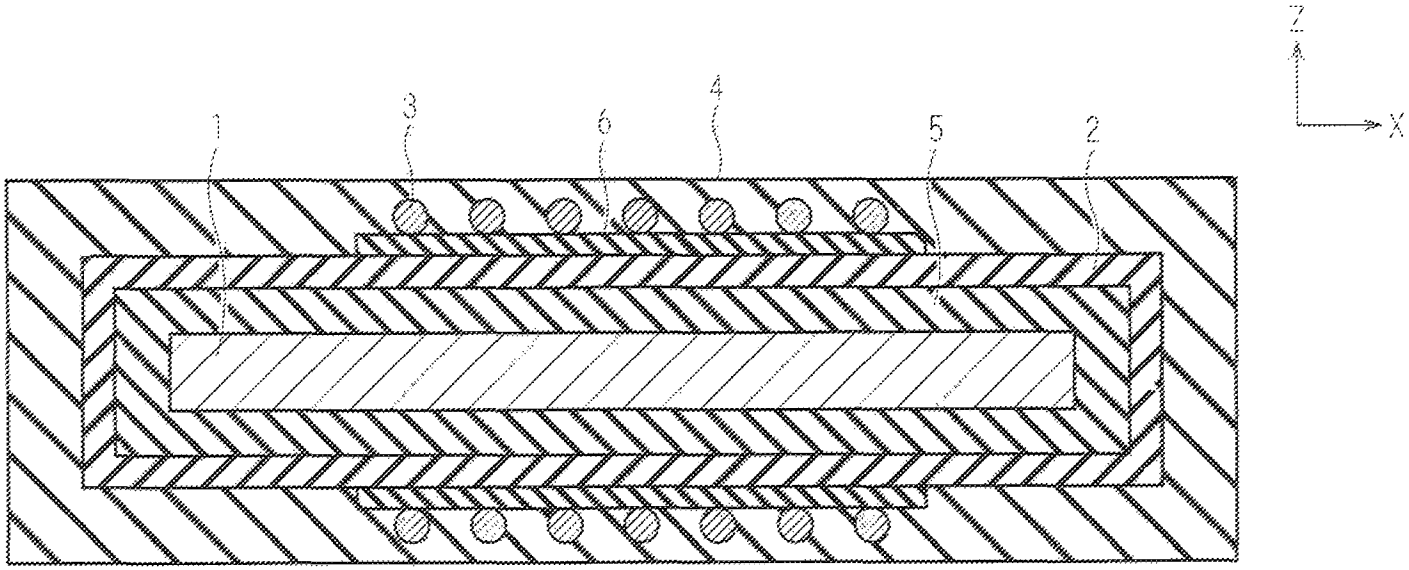
FIG. 4 is a sectional view of the inductor taken along line A-A in FIG. 3.

Next, an inductor according to a second embodiment will be described with reference to FIG. 3 and FIG. 4. FIG. 3 is a plan view illustrating one example of the inductor according to the present embodiment. FIG. 4 is a sectional view taken along line A-A (sectional view of XZ plane) in FIG. 3. As illustrated in FIG. 3 and FIG. 4, the inductor according to the present embodiment further includes a bobbin 6.

The bobbin 6 is a cylindrical member having a surface around which the winding 3 is wound, and is formed of an insulating material. The inductor may be formed in a manner that the bobbin 6 around which the winding 3 is wound and the case 2 housing the magnetic core 1 are respectively manufactured, and then the case 2 is inserted into a hollow portion of the bobbin 6, or the inductor may also be formed by integrating the case 2 and the bobbin 6.

(Third Embodiment)

Figure 5:
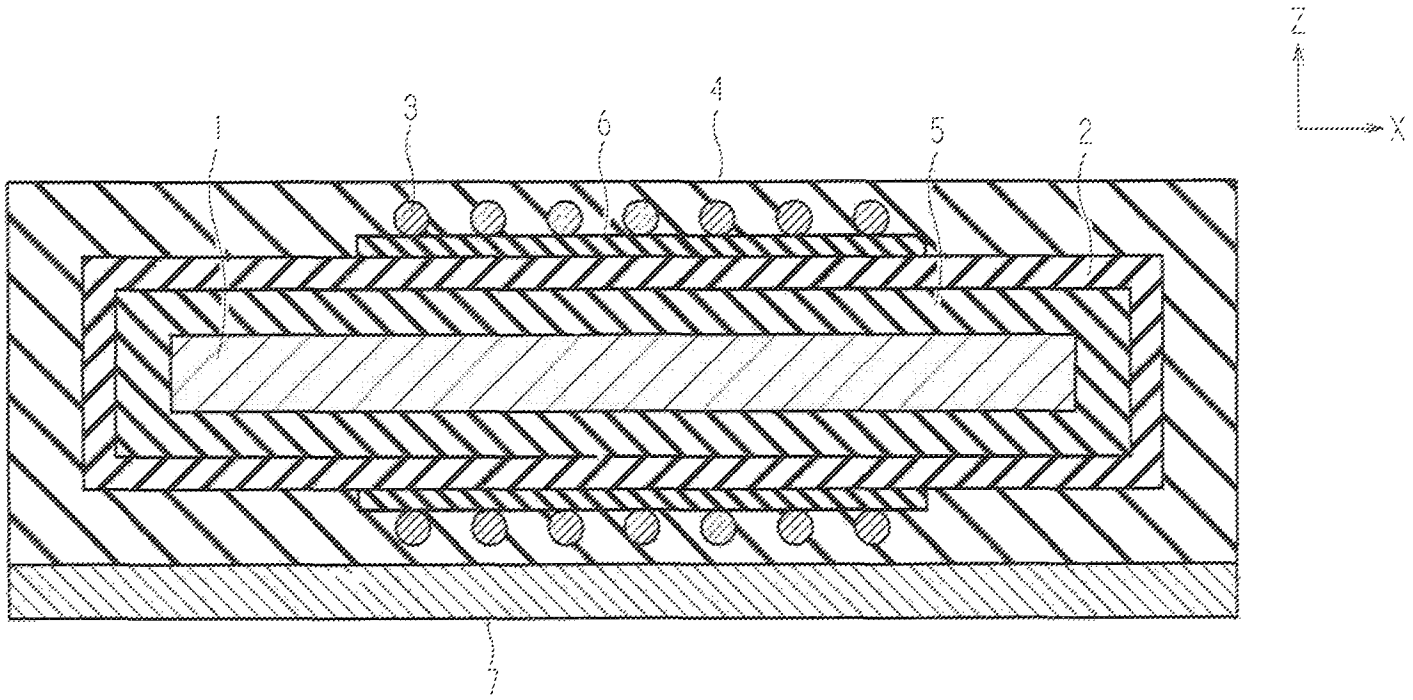
FIG. 5 is a sectional view of XZ plane illustrating one example of an inductor according to a third embodiment.
Figure 6:
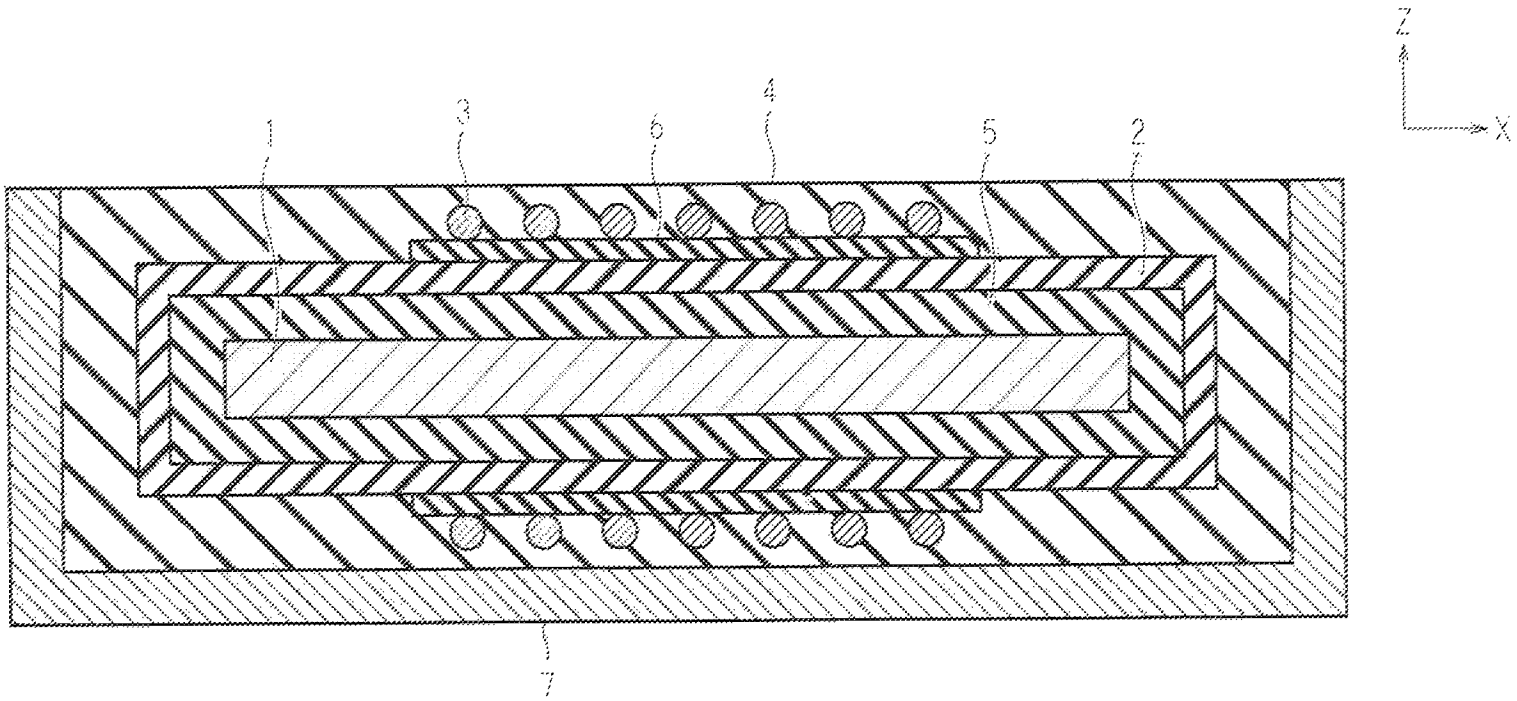
FIG. 6 is a sectional view of XZ plane illustrating one example of an inductor according to the third embodiment.

Next, an inductor according to a third embodiment will be described with reference to FIG. 5 and FIG. 6. Each of FIG. 5 and FIG. 6 is a sectional view of XZ plane illustrating one example of the inductor according to the present embodiment. As illustrated in FIG. 5 and FIG. 6, the inductor according to the present embodiment further includes a conductor plate 7.

The conductor plate 7 is provided so as to cover at least a part of a surface of the resin 4. In FIG. 5, the conductor plate 7 is provided so as to cover a bottom surface of the resin 4. In FIG. 6, the conductor plate 7 is provided so as to cover the bottom surface and side surfaces of the resin 4.

By providing the conductor plate 7 as described above, it is possible to shield an electromagnetic field in a direction in which the conductor plate 7 is provided. When this inductor is used as an inductor for power transmission in a wireless power transmission device, the conductor plate 7 is provided, not on a surface of the resin 4 facing a power transmission direction, but on another surface of the resin 4.

(Fourth Embodiment)

Figure 7:
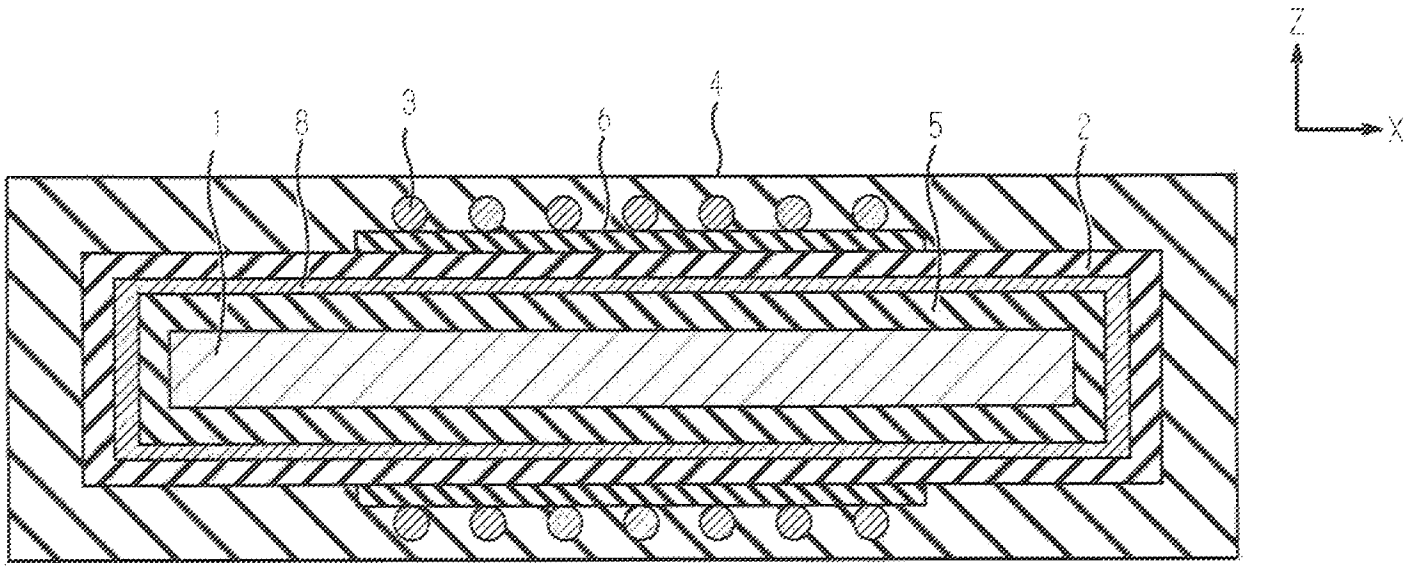
FIG. 7 is a sectional view of XZ plane illustrating one example of an inductor according to a fourth embodiment.
Figure 8:
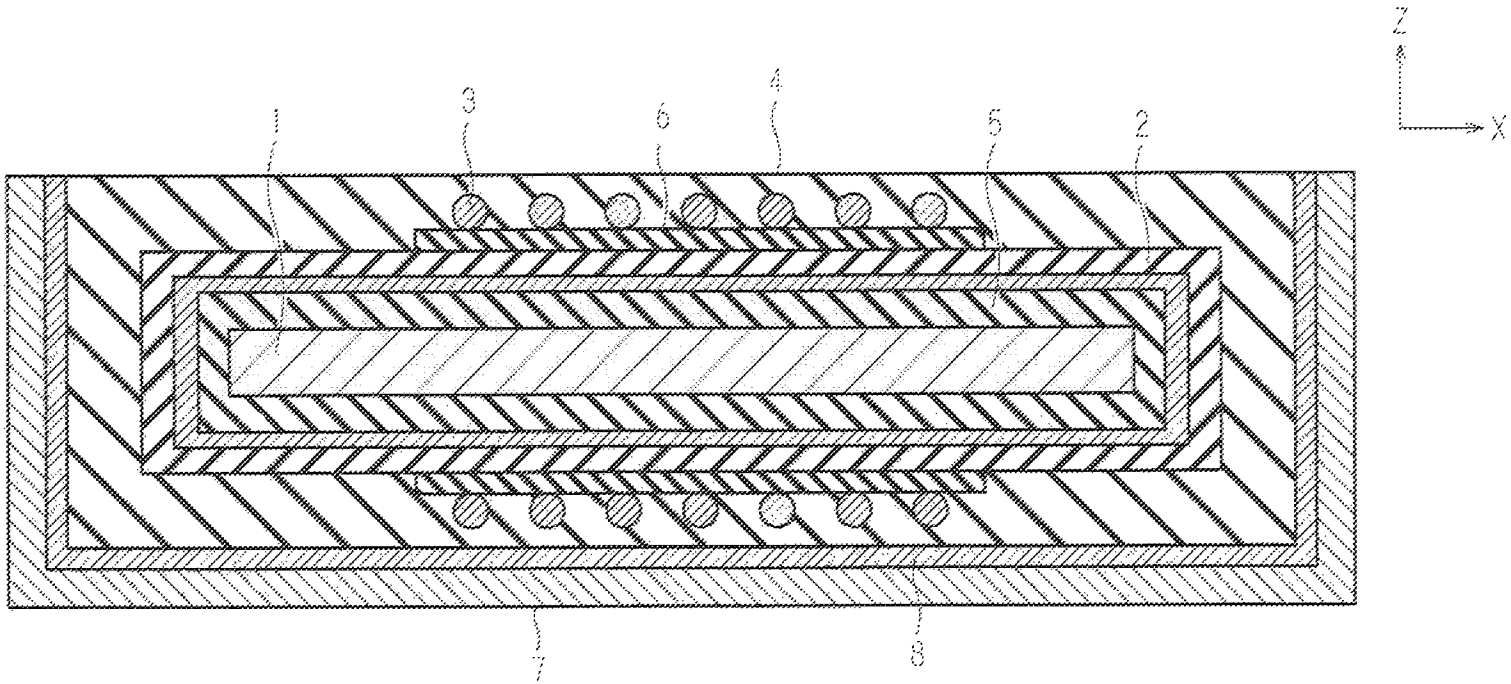
FIG. 8 is a sectional view of XZ plane illustrating one example of an inductor according to the fourth embodiment.

Next, an inductor according to a fourth embodiment will be described with reference to FIG. 7 and FIG. 8. Each of FIG. 7 and FIG. 8 is a sectional view of XZ plane illustrating one example of the inductor according to the present embodiment. As illustrated in FIG. 7 and FIG. 8, the inductor according to the present embodiment includes a semiconductive part 8.

The semiconductive part 8 is formed of paint or a sheet made of the above-described semiconductive material. The semiconductive part 8 is provided to at least either of at least a part of an inner surface of the case 2 and a part of a surface of the resin 4.

The inductor illustrated in FIG. 7 includes the semiconductive part 8 on the entire inner surface of the case 2, namely, at a position between the case 2 and the magnetic core 1. By employing such a configuration, it is possible to mitigate the electric field concentration, so that the partial discharge between the magnetic core 1 and the winding 3 can be suppressed.

The inductor illustrated in FIG. 8 includes the semiconductive part 8 on a part of the surface of the resin 4, namely, at a position between the resin 4 and the conductor plate 7. By employing such a configuration, it is possible to mitigate the electric field concentration, so that the partial discharge between the conductor plate 7 and the winding 3 can be suppressed, Note that it is also possible that the independent semiconductive part 8 as illustrated in FIG. 7 is not provided, and the stress-absorbing member 5 is formed of a semiconductive material. In this case, the stress-absorbing member 5 functions as the semiconductive part 8.

(Fifth Embodiment)

Figure 9:
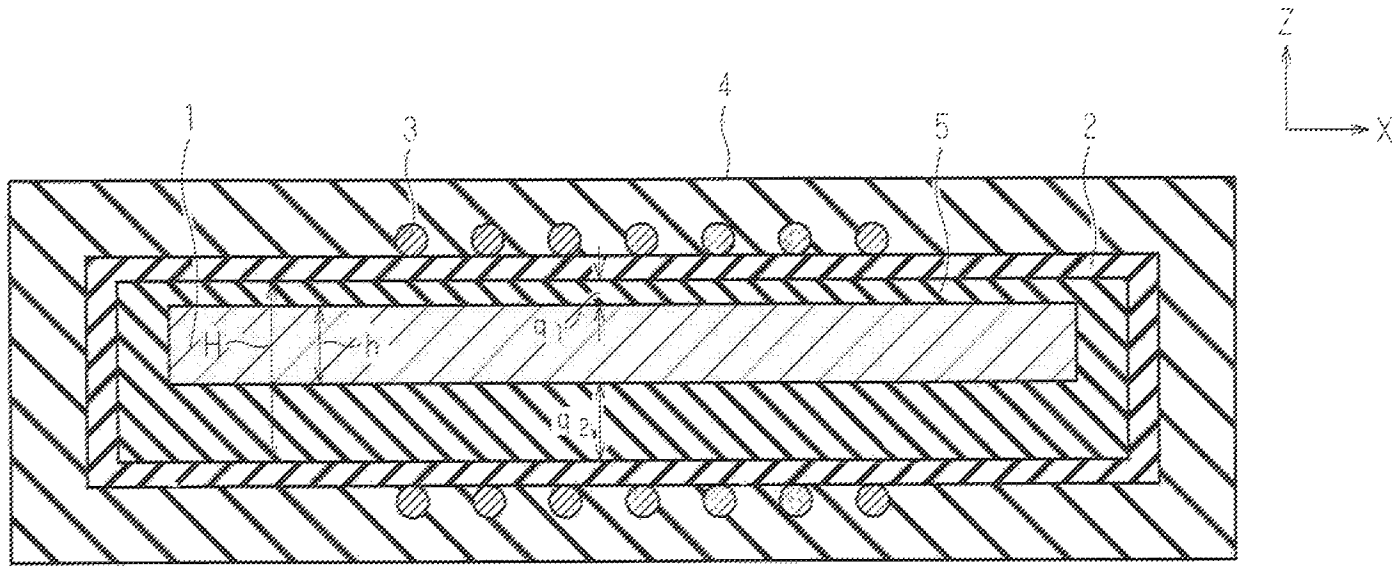
FIG. 9 is a sectional view of XZ plane illustrating one example of an inductor according to a fifth embodiment.
Figure 10:
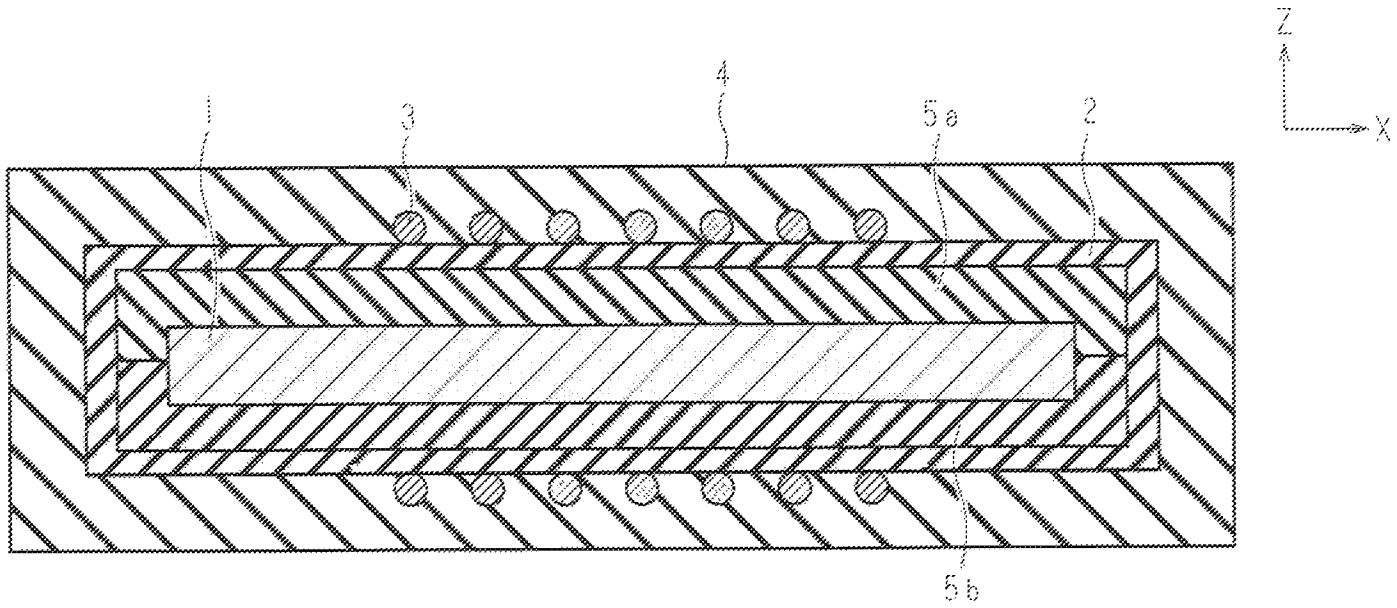
FIG. 10 is a sectional view of XZ plane illustrating one example of an inductor according to the fifth embodiment.

Next, an inductor according to a fifth embodiment will be described with reference to FIG. 9 and FIG. 10. Each of FIG. 9 and FIG. 10 is a sectional view of XZ plane illustrating one example of the inductor according to the present embodiment. The stress-absorbing member 5 of the inductor according to the present embodiment has a high heat radiation part and a low heat radiation part.

The high heat radiation part corresponds to a part, in the stress-absorbing member 5, which exhibits relatively high heat radiation performance from the magnetic core 1. The low heat radiation part corresponds to a part, in the stress-absorbing member 5, which exhibits the heat radiation performance from the magnetic core 1 lower than that of the high heat radiation part. The high heat radiation part and the low heat radiation part can be formed by changing the thickness and the material of the stress-absorbing member 5.

For example, by designing such that the stress-absorbing member 5 includes a small-thickness part and a large-thickness part as illustrated in FIG. 9, it is possible to form the high heat radiation part and the low heat radiation part. The smaller the thickness of the stress-absorbing member 5, the higher the heat radiation performance exhibited by the stress-absorbing member 5 from the magnetic core 1, so that the part with small thickness (second part) of the stress-absorbing member 5 functions as the high heat radiation part, and the part with large thickness (first part) of the stress-absorbing member 5 functions as the low heat radiation part. In FIG. 9, the thickness of the stress-absorbing member 5 is small on the upper side of the magnetic core 1, and is large on the lower side of the magnetic core 1 ($q_1<q_2$). Therefore, the stress-absorbing member 5 on the upper side of the magnetic core 1 functions as the high heat radiation part, and the stress-absorbing member 5 on the lower side of the magnetic core 1 functions as the low heat radiation part.

Further, for example, as illustrated in FIG. 10, it is also possible that the stress-absorbing member 5 is divided into two parts 5*a*, 5*b*, and the respective parts 5*a*, 5*b* are formed of materials with different thermal conductivities. For example, when the upper part 5*a* of the stress-absorbing member 5 in FIG. 10 is formed of a material with high thermal conductivity, and the lower part 5*b* of the stress-absorbing member 5 in FIG. 10 is formed of a material with low thermal conductivity, the part 5*a* (fourth part) functions as the high heat radiation part, and the part 5*b* (third part) functions as the low heat radiation part. Note that it is also possible that the stress-absorbing member 5 is divided into parts of three or more, and the respective parts are formed of materials with different thermal conductivities.

As, described above, by forming the part which exhibits high heat radiation performance from the magnetic core 1, it becomes possible to improve the heat radiation performance of the inductor, and to perform efficient cooling of the inductor.

(Sixth Embodiment)

Figure 11:
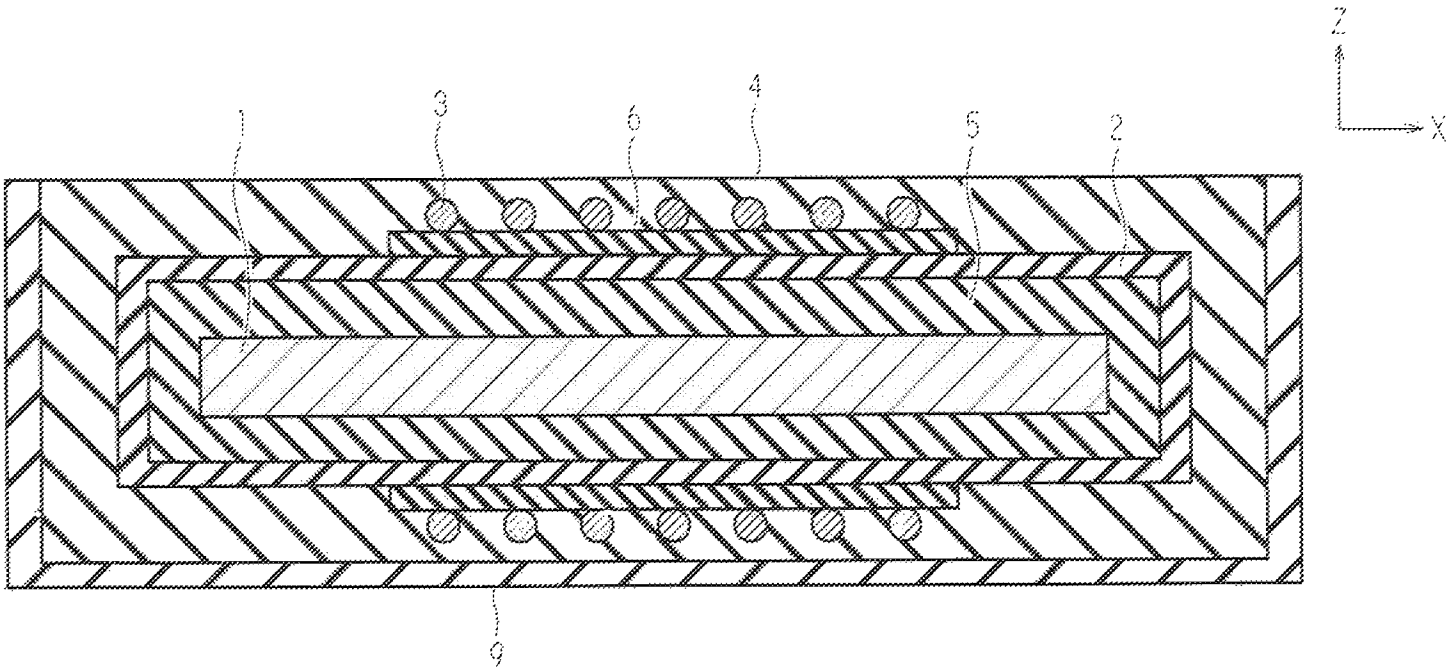
FIG. 11 is a sectional view of XZ plane illustrating one example of an inductor according to a sixth embodiment.
Figure 12:
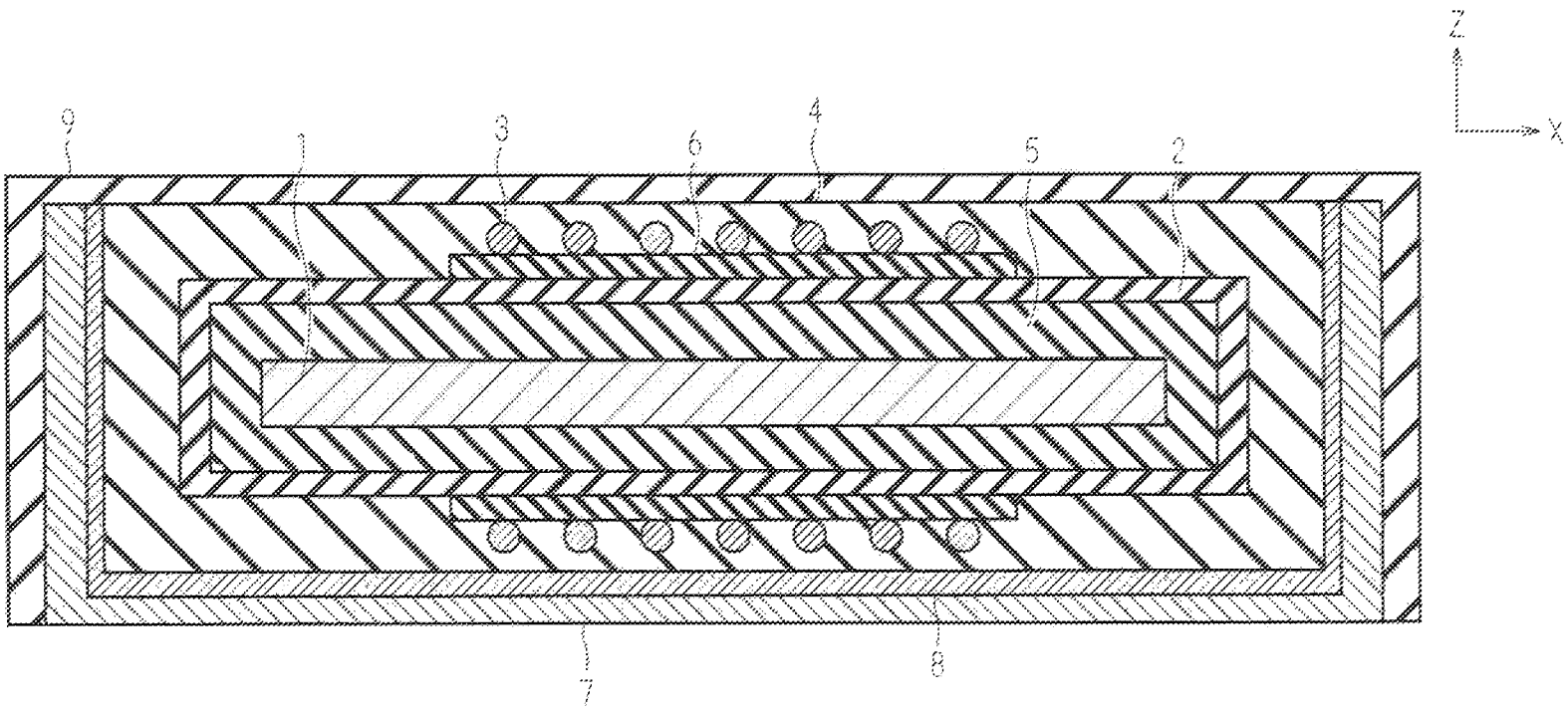
FIG. 12 is a sectional view of XZ plane illustrating one example of an inductor according to the sixth embodiment.

Next, an inductor according to a sixth embodiment will be described with reference to FIG. 11 and FIG. 12. Each of FIG. 11 and FIG. 12 is a sectional view of XZ plane illustrating one example of the inductor according to the present embodiment. As illustrated in FIG. 11 and FIG. 12, the inductor according to the present embodiment further includes a cover 9.

The cover 9 is provided so as to cover at least a part of the surface of the resin 4, By providing the cover 9, it is possible to improve the strength and weather resistance of the inductor. For example, by forming the cover 9 by using a fiber reinforced plastic made of a resin including glass fiber or carbon fiber therein, the mechanical strength of the inductor can be improved. Further, it is possible to roughen the surface of the cover 9 or provide a slip preventer on the surface. Further, it is also possible that, instead of providing the cover 9, the resin 4 is formed of the fiber reinforced plastic. This enables to improve the strength of the inductor.

The inductor in FIG. 11 corresponds to the inductor in FIG. 4 to which the cover 9 is provided. When the cover 9 is formed of a conductor, the cover 9 can also be used as the conductor plate 7.

The inductor in FIG. 12 corresponds to the inductor in FIG. 8 to which the cover 9 is provided. As illustrated in FIG. 12, the cover 9 may also be provided so as to cover a power transmission direction. In this case, the cover 9 is preferably formed of an insulator in order not to prevent the power transmission.

(Seventh Embodiment)

Figure 13:
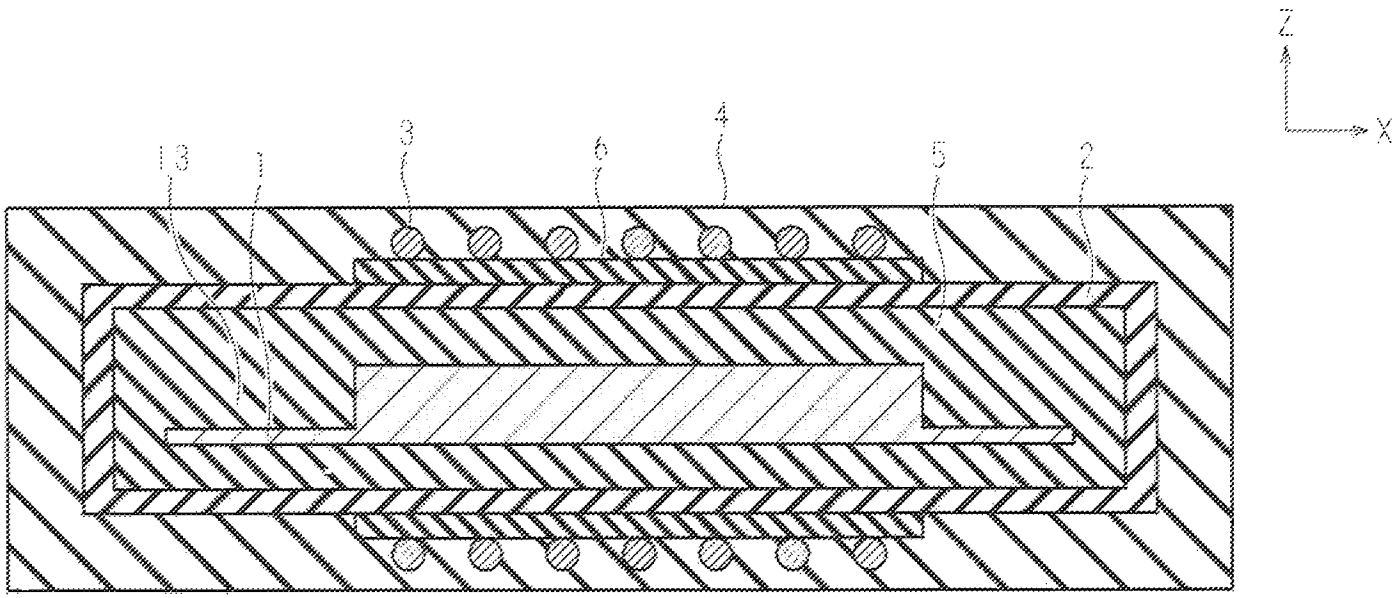
FIG. 13 is a sectional view of XZ plane illustrating one example of an inductor according to a seventh embodiment.
Figure 14:
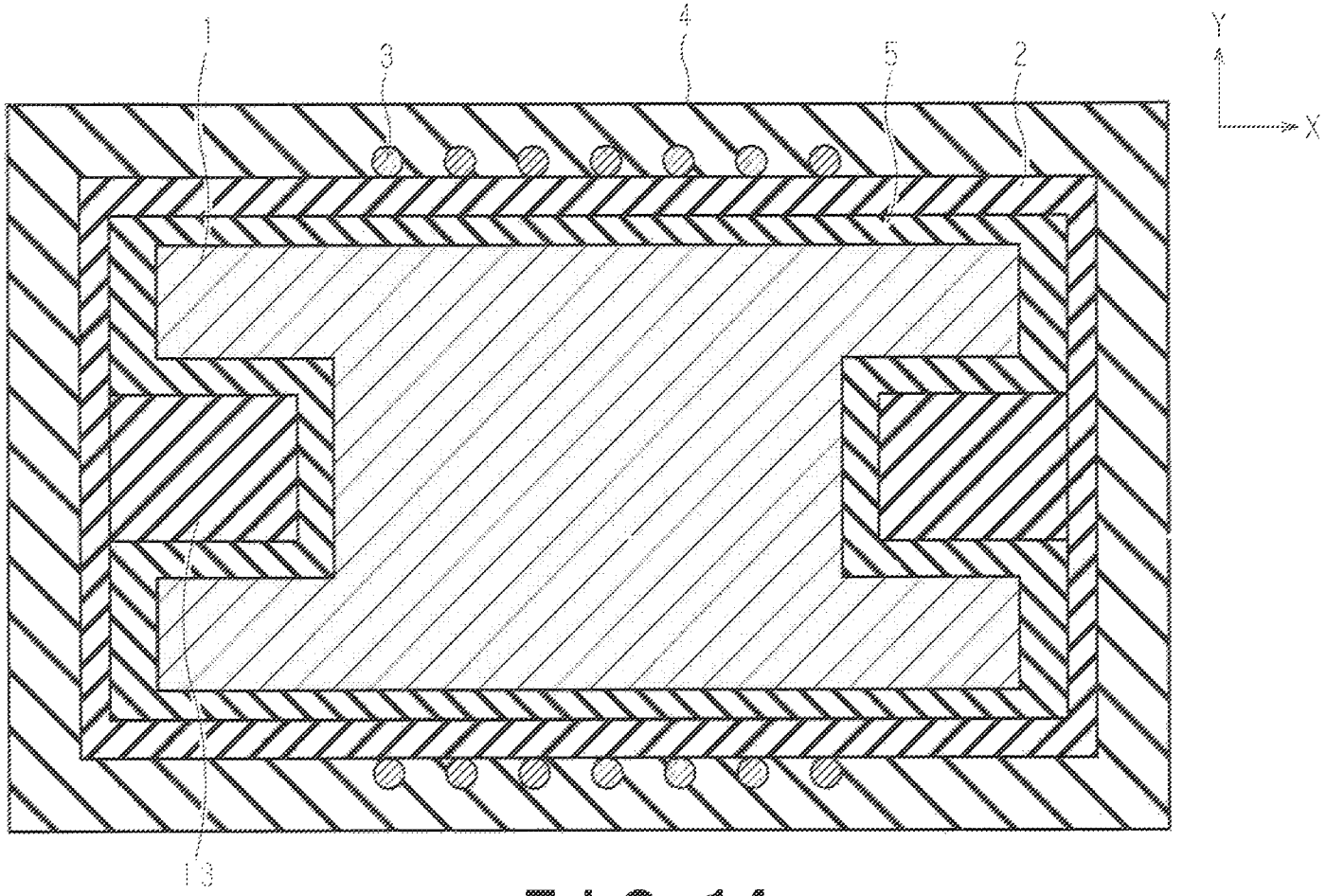
FIG. 14 is a sectional view of XY plane illustrating one example of an inductor according to the seventh embodiment.

Next, an inductor according to a seventh embodiment will be described with reference to FIG. 13 and FIG. 14. Each of FIG. 13 and FIG. 14 is an XY sectional view illustrating one example of the inductor according to the present embodiment. As illustrated in FIG. 13 and FIG. 14, a part of the magnetic core 1 of the inductor according to the present embodiment is formed to have a large cross-sectional area in the magnetic flux direction.

In the present embodiment, the magnetic core 1 is formed in a manner that a part thereof in the vicinity of the winding 3 has a cross-sectional area in the magnetic flux direction larger than that of the other part. The part in the vicinity of the winding 3 corresponds to a part, in the magnetic core 1, surrounded by the winding 3. The part in the vicinity of the winding 3 is a part having the maximum magnetic flux density, in the magnetic core 1. When the cross-sectional area of this part is increased, the magnetic flux density in the magnetic core 1 can be reduced.

Generally, the core loss is generated in the inductor having the magnetic core 1. The core loss indicates energy loss which occurs in the magnetic core 1. The core loss includes hysteresis loss and overcurrent loss. The core loss increases as the magnetic flux density in the magnetic core 1 increases. Therefore, as in the present embodiment, by increasing the thickness of a part of the magnetic core 1 to reduce the magnetic flux density of the magnetic core 1, it is possible to reduce the core loss. Further, in the structure in FIG. 13 or FIG. 14, it is also possible to incorporate a resonance capacitor in a space 13, of the case 2, which is formed since the cross-sectional area of the magnetic core 1 is reduced.

(Eighth Embodiment)

Figure 15:
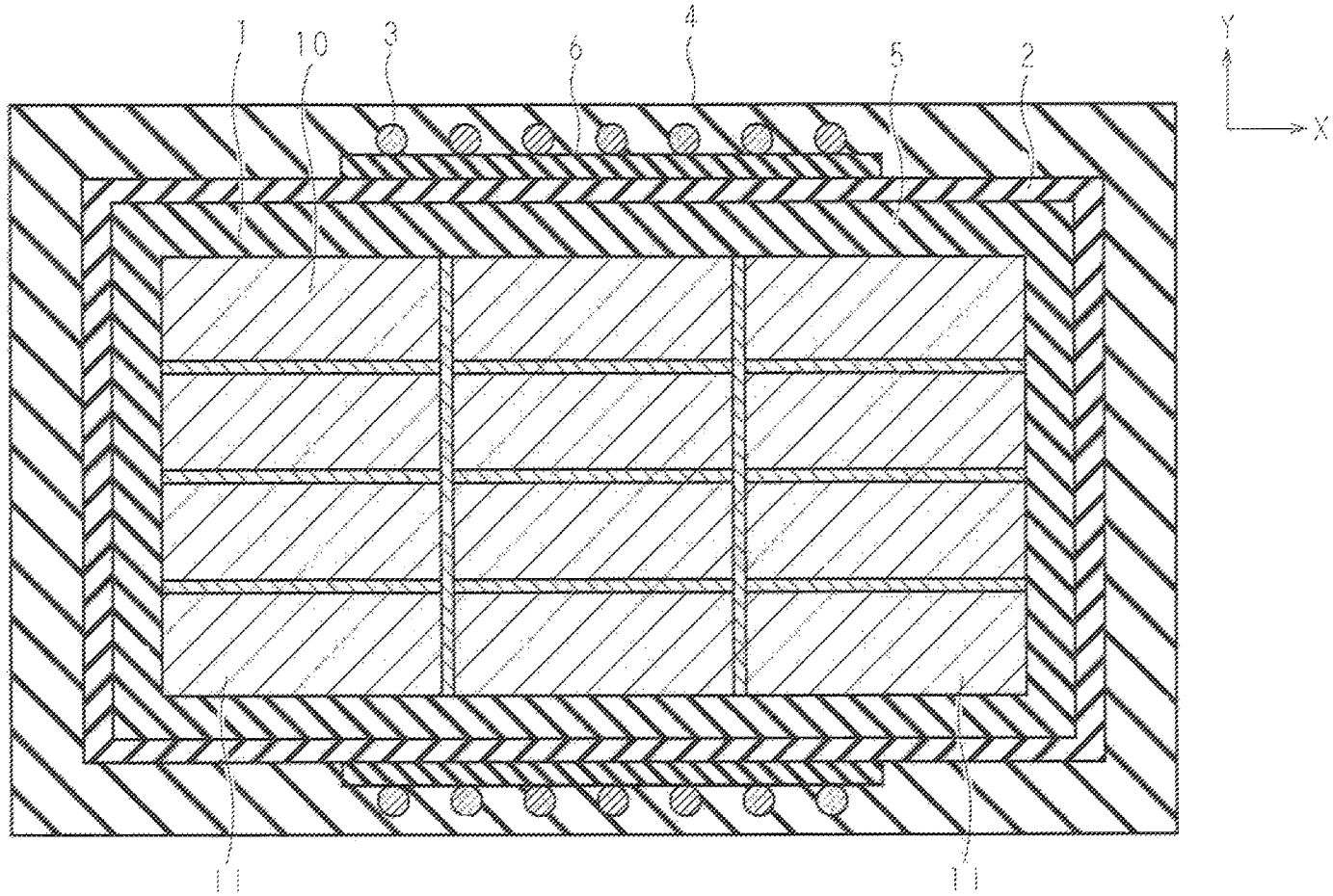
FIG. 15 is a sectional view of XY plane illustrating one example of an inductor according to an eighth embodiment.
Figure 16:
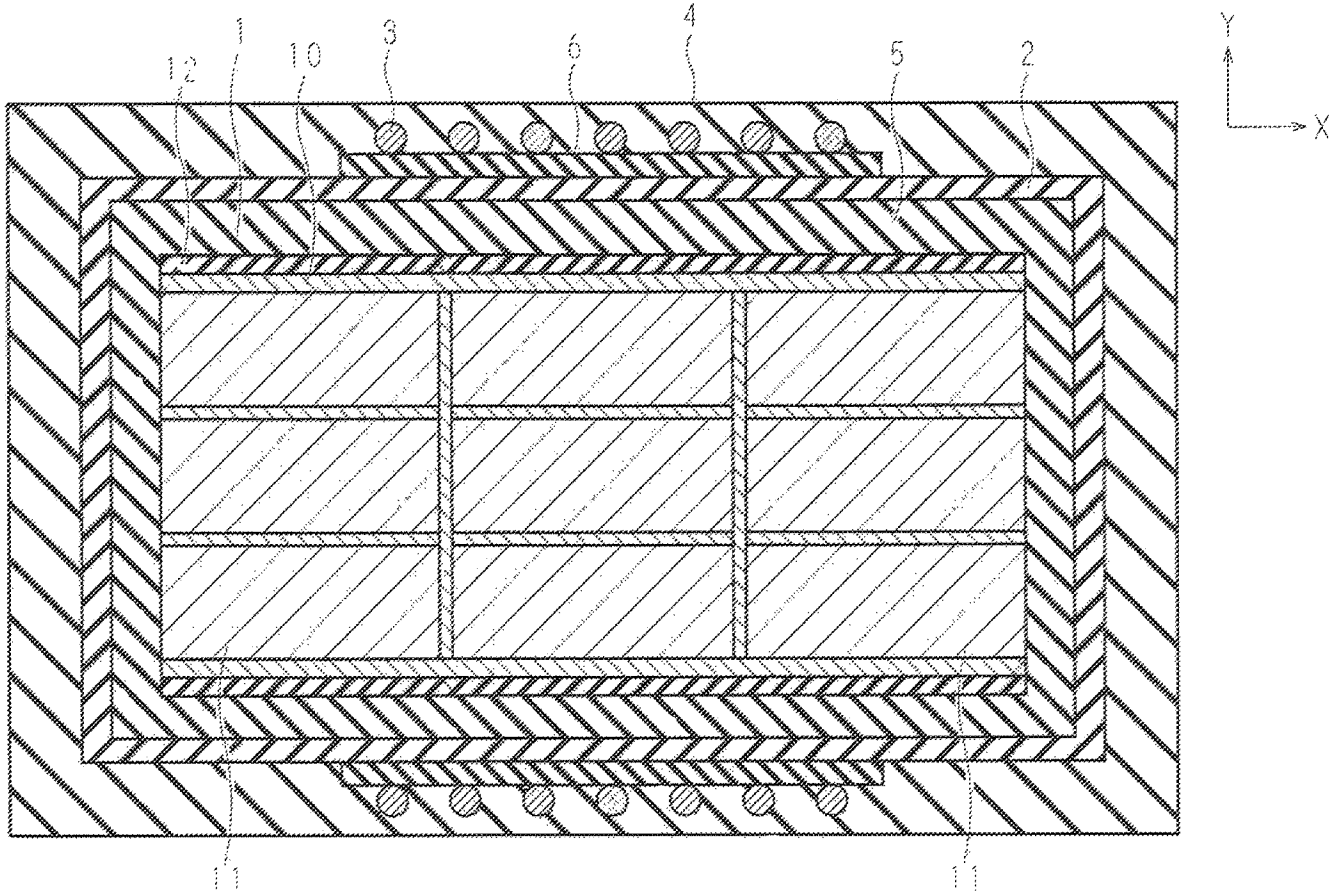
FIG. 16 is a sectional view of XY plane illustrating one example of an inductor according to the eighth embodiment.

Next, an inductor according to an eighth embodiment will be described with reference to FIG. 15 and FIG. 16. Each of FIG. 15 and FIG. 16 is a sectional view of XY plane illustrating one example of the inductor according to the present embodiment. As illustrated in FIG. 15, the magnetic core 1 of the inductor according to the present embodiment is obtained in a manner that a plurality of magnetic substance pieces 11 are arranged in a plane state, and are mutually coupled. Each of the magnetic substance pieces 11 has an approximately flat plate shape, and the magnetic core 1 has a large plate shape as a whole.

Each of the magnetic substance pieces 11 is configured by ferrite, a powder magnetic core, an electromagnetic steel sheet, or the like, The reason why the magnetic core 1 is formed of the plurality of magnetic substance pieces 11, is as follows.

When the inductor is used for wireless power transmission, the size of the inductor is determined depending on power to be transmitted or a transmission distance, For example, when power is transmitted to a position separated by about 10 cm, a large-sized inductor whose one side has a length of about several tens of cm, is used. When the magnetic core 1 is formed of ferrite, a powder magnetic core, or the like, it is difficult to manufacture a large-sized core due to a molding process or a burning process. Accordingly, as in the present embodiment, the plurality of the small-sized magnetic substance pieces 11 are coupled to be used as the core of the large-sized inductor.

Regarding the plurality of magnetic substance pieces 11 which form the magnetic core 1, adjacent magnetic substance pieces 11 are mutually coupled via a fluid material filled with a magnetic substance material. As the magnetic substance material to be filled, it is possible to use a powdered or granular material, for example. As the fluid material, it is possible to use, for example, an adhesive made of a resin material such epoxy resin or silicone. In FIG. 15, the respective magnetic substance pieces 11 are coupled by an adhesive 10 filled with ferrite powder as magnetic substance powder.

The adhesion between the magnetic substance pieces 11 is conducted in a manner that, for example, the adhesive 10 is applied to side surfaces of the respective magnetic substance pieces 11, and the respective magnetic substance pieces 11 are pressed against each other for a certain period of time or longer. This makes it possible to form the magnetic core 1 in which generation of a region with low relative permeability due to a gap of air or the like is suppressed between the magnetic substance pieces 11. Therefore, a local magnetic flux concentration in the magnetic core 1 is suppressed, resulting in that the core loss can be reduced.

In the present embodiment, it is also possible to couple the mutual magnetic substance pieces 11 by using a fluid material such as a resin-based material having no adhesive force or weak adhesive force in which the magnetic substance powder is filled. Further, it is also possible to employ a configuration in which the respective magnetic substance pieces 11 are coupled by using a material made solely of ferrite powder. In this case, it is also possible that, in order to maintain the coupling of the mutual magnetic substance pieces 11, a sheet 12 is attached to both sides or one side of the magnetic core 1 with an adhesive, to thereby fix the respective magnetic substance pieces 11, as illustrated in FIG. 16.

As the sheet 12, it is possible to use a polyimide film, a silicon-based sheet, an acrylic sheet, or the like. Further, as the sheet 12, it is also possible to use glass cloth, instead of the above-described sheet. The sheet 12 and the adhesive 10 may also be made of a resin material such as unsaturated polyester, for example.

(Ninth Embodiment)

Figure 17:
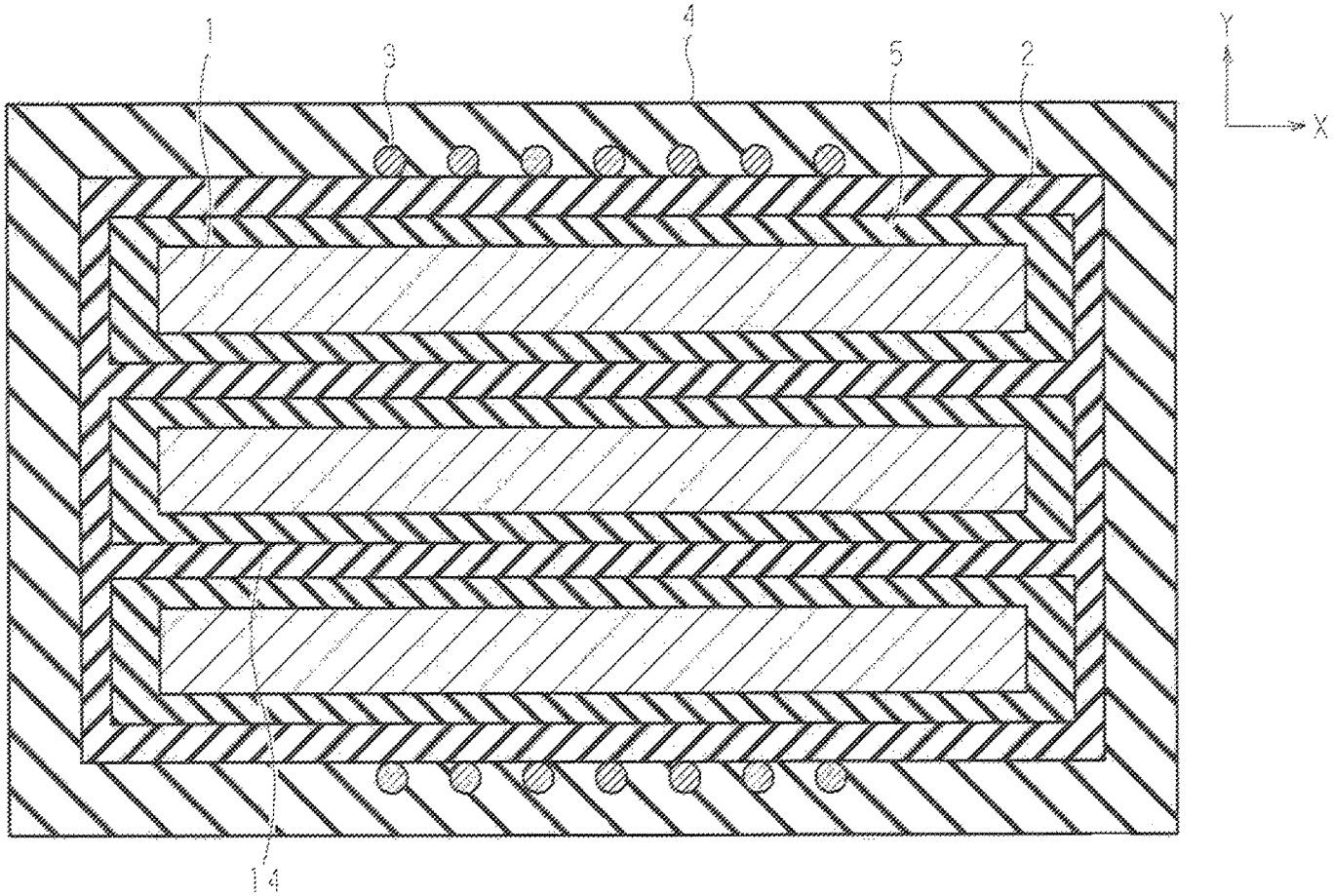
FIG. 17 is a sectional view of XY plane illustrating one example of an inductor according to a ninth embodiment.
Figure 18:
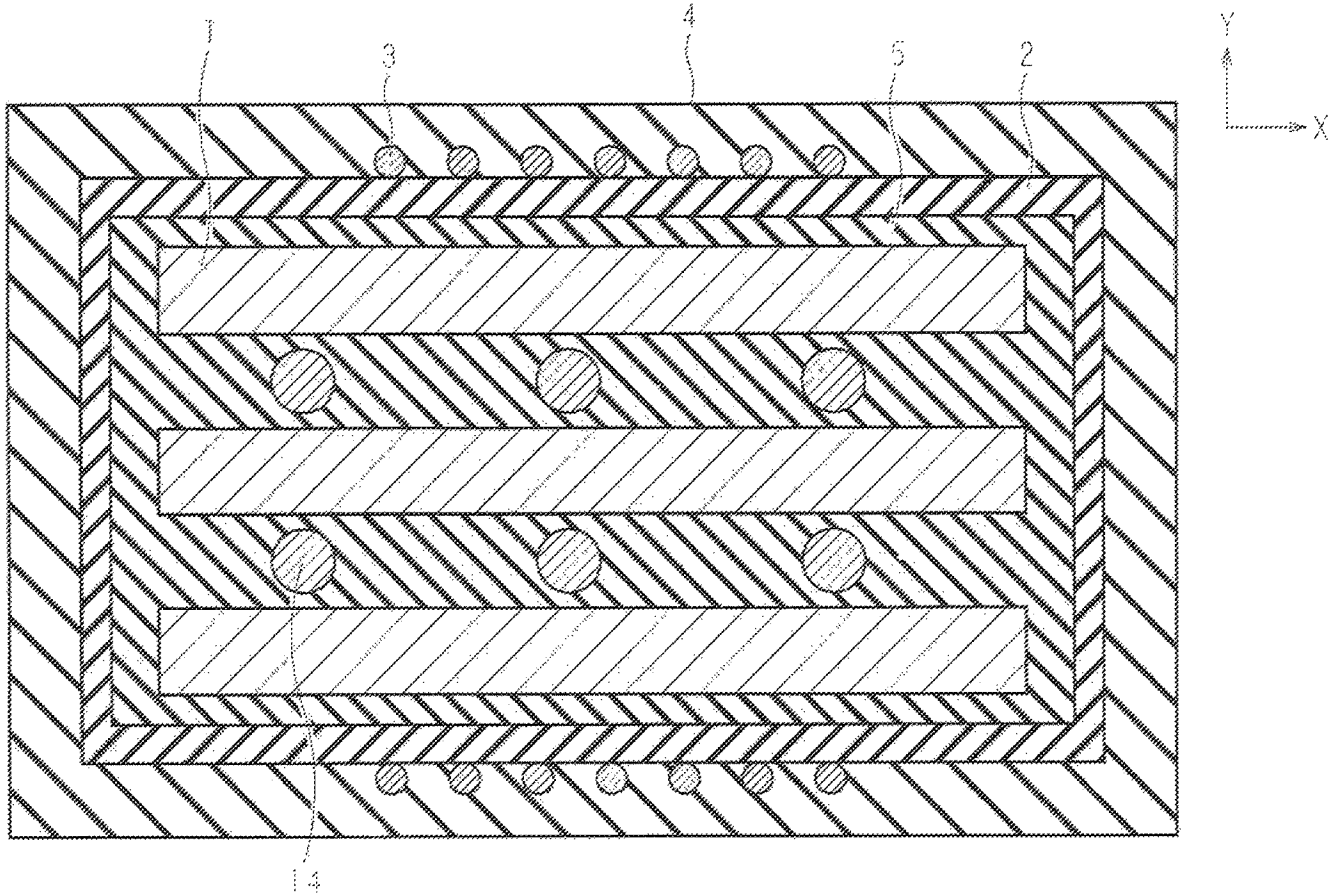
FIG. 18 is a sectional view of XY plane illustrating one example of an inductor according to the ninth embodiment.
Figure 19:
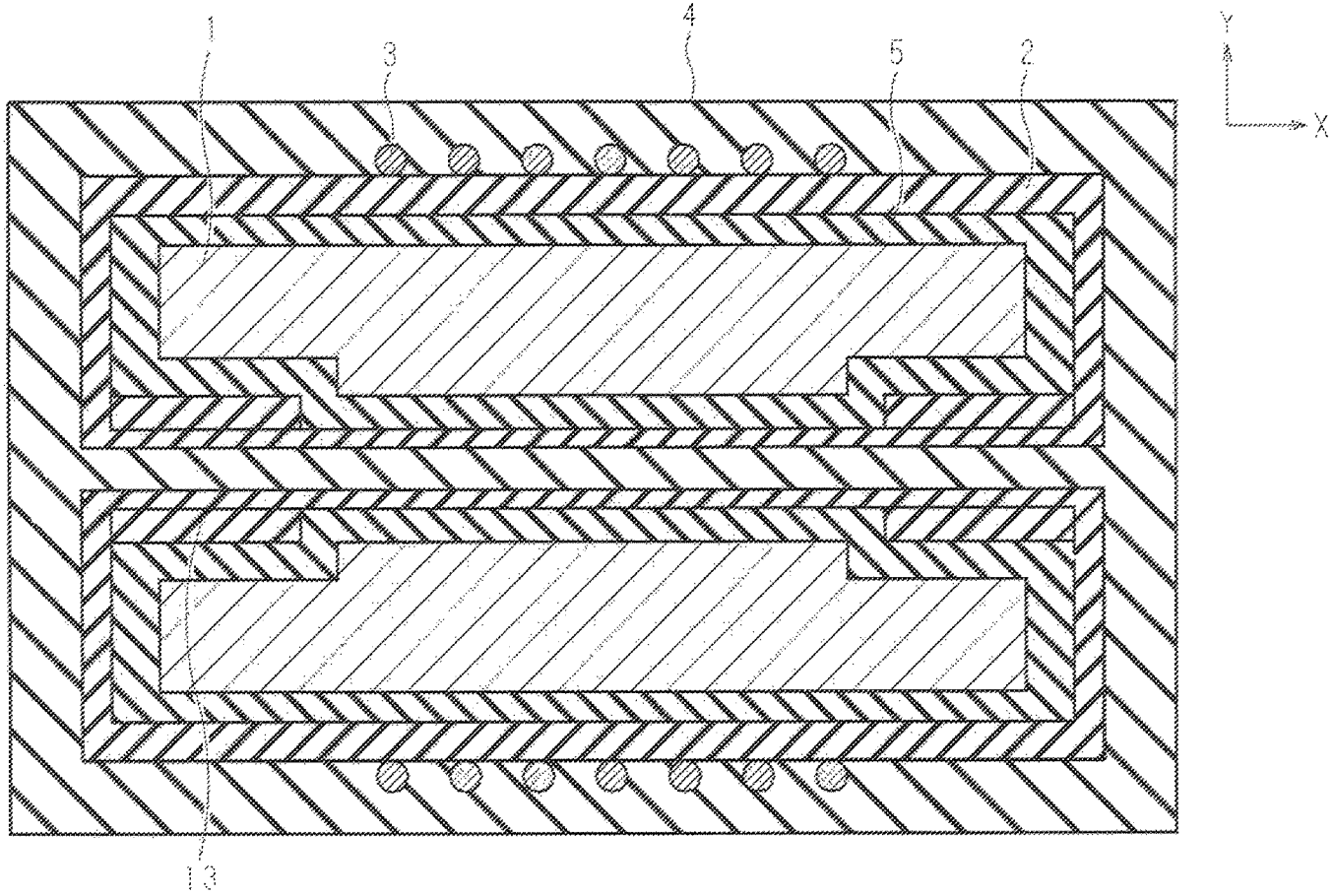
FIG. 19 is a sectional view of XY plane illustrating one example of an inductor according to the ninth embodiment.

Next, an inductor according to a ninth embodiment will be described with reference to FIG. 17 to FIG. 19. Each of FIG. 17 to FIG. 19 is a sectional view of XY plane illustrating one example of the inductor according to the present embodiment. As illustrated in FIG. 17 to FIG. 19, the case 2 of the inductor according to the present embodiment further includes a reinforcement 14.

The reinforcement 14 suppresses deformation of the case 2 due to the curing shrinkage of the resin 4 or the thermal shrinkage of the case 2. It is also possible that, as illustrated in FIG. 17, a sidewall which divides the case 2 into a plurality of regions is provided inside the case 2, as the reinforcement 14. Alternatively, it is also possible that, as illustrated in FIG. 18, support posts which divide the case 2 into a plurality of regions are provided inside the case 2, as the reinforcement 14. As illustrated in FIG. 17 and FIG. 18, when the inside of the case 2 is divided into the plurality of regions by the reinforcement 14, the magnetic core 1 is housed in each of the divided regions.

Further, as illustrated in FIG. 19, by setting a cross-sectional area in the magnetic flux direction of a part in the vicinity of the winding 3 of the magnetic core 1 to be larger than a cross-sectional area in the magnetic flux direction on the outside of the part in the vicinity of the winding 3 of the magnetic core 1, it is possible to reduce the core loss, It is also possible to incorporate a resonance capacitor in a space 13, of the case 2, which is formed since the cross-sectional area in the magnetic flux direction of the magnetic core 1 is reduced.

According to the present embodiment, the deformation of the case 2 is suppressed by the reinforcement 14, so that it is possible to further suppress the stress applied to the magnetic core 1 housed in the case 2.

(Tenth Embodiment)

Next, a wireless power transmission device according to a tenth embodiment will be described with reference to FIG. 20 and FIG. 21. The wireless power transmission device according to the present embodiment includes the inductors according to each of the above-described embodiments. The wireless power transmission device mentioned here includes a power reception device and a power transmission device for performing wireless power transmission. Hereinafter, the power reception device and the power transmission device will be separately described.

Figure 20:
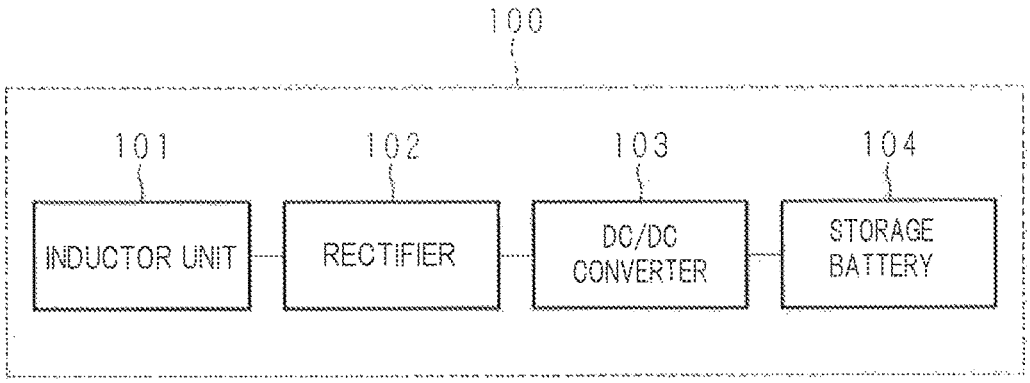
FIG. 20 is a block diagram illustrating one example of a power reception device according to a tenth embodiment.
Figure 21:
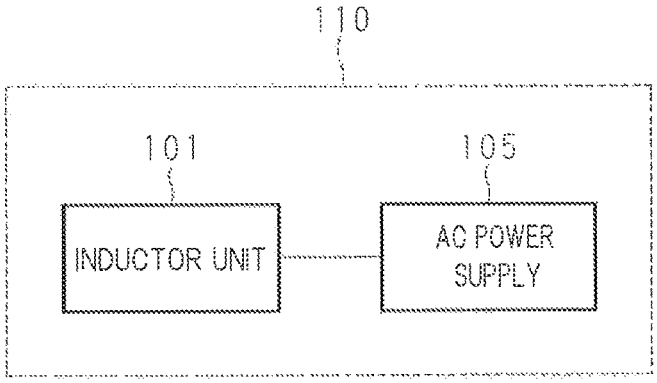
FIG. 21 is a block diagram illustrating one example of a power transmission device according to the tenth embodiment.

FIG. 20 is a block diagram illustrating a schematic configuration of a power reception device 100 according to the present embodiment. As illustrated in FIG. 20, the power reception device 100 includes an inductor unit 101, a rectifier 102, a DC/DC converter 103, and a storage battery 104.

The inductor unit 101 includes one or a plurality of the inductor(s) according to each of the above-described embodiments. In the power reception device 100, the inductor resonates with an inductor on a power transmission side, to thereby receive power. The received power is input into the rectifier 102. Note that the inductor unit 101 may also include, not only the inductor(s) but also a capacitor which forms a resonance circuit or a circuit for improving a power factor.

The rectifier 102 rectifies AC power input from the inductor unit 101 to DC power. The rectifier 102 is formed of, for example, a bridge circuit using a diode. The power rectified by the rectifier 102 is input into the DC/DC converter 103.

The DC/DC converter 103 adjusts voltage so that appropriate voltage is applied to the storage battery 104. The voltage adjusted by the DC/DC converter 103 is input into the storage battery 104. Note that it is also possible to configure such that the power reception device 100 does not include the DC/DC converter 103.

The storage battery 104 stores the power input from the DC/DC converter 103 or the rectifier 102. As the storage battery 104, it is possible to use an arbitrary storage battery such as a lead storage battery or a lithium-ion battery. Note that it is also possible to configure such that the power reception device 100 does not include the storage battery 103, FIG. 21 is a block diagram illustrating a schematic configuration of a power transmission device 110 according to the present embodiment. As illustrated in FIG. 21, the power transmission device 110 includes an inductor unit 101, and an AC power supply 105.

The AC power supply 105 inputs AC power into the inductor unit 101. For example, power is input into the AC power supply 105 from a commercial power supply, the AC power supply 105 rectifies the power input therein, and outputs AC power by using an inverter circuit. Further, the AC power supply 105 may also be configured to include a circuit which adjusts voltage of commercial power; DC power, or AC power, and a power factor correction circuit called as a PFC circuit. The inductor in the inductor unit 101 generates an AC magnetic field with the use of the power input from the AC power supply 105, and transmits power to the inductor on the power reception side.

The above-described power reception device 100 and power transmission device 110 transmit power via the inductors according to each of the above-described embodiments, so that core loss when receiving power and when transmitting power is small. Therefore, the power reception device 100 and the power transmission device 110 can transmit power at a high transmission efficiency.

It should be noted that the present invention is not limited to the above-described respective embodiments as they are, but may be embodied with components being modified in a range not departing from the contents thereof at the stage of implementation. Further, various inventions can be formed by appropriately combining a plurality of components disclosed in the above-described respective embodiments. Further, for example, there can be considered a configuration in which some of all the components shown in the respective embodiments are deleted. Further, components described in different embodiments can be combined appropriately.

The invention claimed is:

1. An inductor, comprising:

a magnetic core;

a case configured to house the magnetic core;

a winding configured to be wound around the case; and a resin configured to be formed of a first resin to cover the case and the winding, wherein a difference between an inside dimension of the case and a dimension of the magnetic core in the same direction is greater than a variation of a dimension of the case in the direction when forming the resin.

2. The inductor according to claim 1, wherein the variation of the dimension of the case is a product of a linear expansion coefficient of the case, a dimension of the case at an operating temperature, and a variation of temperature of the case when forming the resin.

3. The inductor according to claim 1, wherein the case and the resin are formed of the same resin material.

4. The inductor according to claim 1, further comprising a stress-absorbing member provided at least a part of between the case and the magnetic core to fix the magnetic core.

5. The inductor according to claim 4, wherein the stress-absorbing member is formed of a material having a modulus of elasticity lower than that of the resin.

6. The inductor according to claim 1, further comprising a bobbin around which the winding is wound.

7. The inductor according to claim 1, further comprising a conductor plate configured to cover at least a part of a surface of the resin.

8. The inductor according to claim 1, further comprising a semiconductive part, on at least a part of an inner surface of the case, formed of a material having conductivity higher than that of the first resin.

9. The inductor according to claim 8, further comprising a semiconductive part, between the resin and the conductor plate, formed of a material having conductivity higher than that of the first resin.

10. The inductor according to claim 9, wherein the semiconductive part is formed of a sheet, paint, or the stress-absorbing member, which is made of a material having conductivity higher than that of the first resin.

11. The inductor according to claim 4, wherein the stress-absorbing member comprises a first part having a large thickness, and a second part having a thickness smaller than that of the first part.

12. The inductor according to claim 4, wherein the stress-absorbing member comprises a third part having low thermal conductivity, and a fourth part having thermal conductivity higher than that of the third part.

13. The inductor according to claim 1, further comprising a cover configured to cover at least a part of a surface of the resin.

14. The inductor according to claim 1, wherein a part in the vicinity of the winding of the magnetic core has a cross-sectional area in a magnetic flux direction larger than that of the other part of the magnetic core.

15. The inductor according to claim 1, wherein the magnetic core comprises a plurality of magnetic substance pieces arranged in a plane state and mutually coupled by a material containing a magnetic substance material.

16. The inductor according to claim 15, further comprising a sheet or glass cloth attached to both sides or one side of the plurality of magnetic substance pieces with an adhesive.

17. The inductor according to claim 1, wherein the case comprises a reinforcement which suppresses deformation.

18. The inductor according to claim 17, wherein the case is divided into a plurality of regions by the reinforcement, and the magnetic core is housed in each of the regions of the case.

* * * * *